US007134967B2

(12) United States Patent
Lester

(10) Patent No.: US 7,134,967 B2
(45) Date of Patent: Nov. 14, 2006

(54) TRAINING AID THAT GENERATES AN IMPRESSION ON A HITTING INSTRUMENT

(76) Inventor: David Lester, 2517 Rockbridge Dr., Carson City, NV (US) 89706

( * ) Notice: Subject to any disclaimer, the term of this patent is extended or adjusted under 35 U.S.C. 154(b) by 0 days.

(21) Appl. No.: 10/757,618

(22) Filed: Jan. 13, 2004

(65) Prior Publication Data

US 2005/0153790 A1 Jul. 14, 2005

(51) Int. Cl.
*A63B 69/36* (2006.01)

(52) U.S. Cl. ..... 473/237

(58) Field of Classification Search ..... 473/237, 473/224, 324, 329, 330, 190
See application file for complete search history.

(56) References Cited

U.S. PATENT DOCUMENTS 2,660,436 A * 11/1953 Grossman ..... 473/237
3,754,764 A 8/1973 Manheck
3,806,132 A * 4/1974 Brandell ..... 473/237
4,974,851 A 12/1990 Closser et al.
5,033,746 A * 7/1991 Jones ..... 473/237
5,142,309 A 8/1992 Lee
5,597,361 A 1/1997 Hope
5,609,530 A * 3/1997 Butler, Jr. ..... 473/237
5,779,556 A 7/1998 Cervantes et al.
5,830,077 A 11/1998 Yavitz

OTHER PUBLICATIONS

WebPage, Dundas, 2001, www.dundasjafine.com/products/energy/foilbacked.html, 3 pages.*

* cited by examiner

*Primary Examiner*—Eugene Kim
*Assistant Examiner*—M. Chambers
(74) *Attorney, Agent, or Firm*—Virtual Legal, P.C.; Michael A. Kerr

(57) ABSTRACT

A training aid that is attached to a hitting instrument such as a golf club. The training aid comprises and opaque and malleable material that is configured to be deformed upon impact with a ball. Additionally, the training aid comprises a deformable sheet that is attached to said opaque and malleable material. The back face of the deformable sheet includes a means for affixing the training aid to the hitting instrument.

9 Claims, 4 Drawing Sheets

TRAINING AID THAT GENERATES AN IMPRESSION ON A HITTING INSTRUMENT

BACKGROUND

1. Field

The field is related to training aids for determining the point of contact between a ball and a hitting instrument. More particularly, the field is related to golfing training aids and other such athletic training aids.

2. Description of Related Art

For a golf player to strike a golf ball in a consistent manner, the player should have a consistent swing and should consistently hit the golf ball with the "sweet spot" of his golf club. The sweet spot is an area that permits the player to achieve the optimal distance and control over the golf ball. Generally, players consistently practice to obtain a consistent swing. However, during the process of practicing one's golf swing, the player has difficulty determining whether he properly struck the golf ball in the desired sweet spot. If the golf ball is not struck properly, the player may inter alia "top", "slice", or "hook" the ball.

The process of improving a golfer's swing is the subject for various training devices. Most of these training devices are expensive and difficult to use and provide little information about whether the player hit the sweet spot. One device that helps identify where the player hit the golf ball on the face of the club is the golf club impact marker. The golf club impact marker provides specific feedback on the precise location or point of contact between the golf ball and the golf club.

Various golf impact markers are described in the prior art. Generally, the prior art golf impact markers include an outer translucent sheet and an inner sheet with a pressure or temperature sensitive material. Additional sheets may be required depending on the properties of the translucent sheet and the pressure or temperature sensitive material.

Although the use of the hitting instrument described above is restricted to a golf club, those skilled in the art having the benefit of this disclosure shall appreciate that the apparatus and method described hereinafter can be applied more broadly to a variety of hitting instruments. For example, the hitting instrument may be a baseball bat, a hockey stick, and any other such hitting instrument in which a player desires to measure the striking of ball.

SUMMARY

A training aid apparatus and method that generates an impression on a hitting instrument. The method comprises affixing the training aid to the hitting instrument, which for illustrative purposes is a golf club. The training aid comprises an opaque and malleable material, a deformable sheet attached to the opaque and malleable material, and an adhesive layer that affixes the training aid to the hitting instrument. A player then proceeds to strike the ball with the hitting instrument. When the hitting instrument strikes the ball, the opaque and malleable material is deformed and generates an impression of the ball. The impression can then be interpreted to determine how to better strike the ball. Typically, the impression comprises a ball pattern and one or more ridges.

In the illustrative embodiment, the training aid is a golf training aid. The golf training aid is attached to a golf club face that strikes a golf ball. The training aid comprises an opaque and malleable material, a deformable sheet, and a means for affixing the training aid to the hitting instrument. The opaque and malleable material is deformed upon impact with the golf ball. The deformable sheet has a front face that is attached to the opaque and malleable material. By way of example and not of limitation, the illustrative means for affixing the training aid to the instrument is a first adhesive layer that is on the back face of the deformable sheet. The illustrative first adhesive layer leaves little or no adhesive residue on the golf club face when the golf training aid is removed from the golf club face.

BRIEF DESCRIPTION OF THE DRAWINGS

Embodiments for the following description are shown in the following drawings.

DESCRIPTION

In the following detailed description, reference is made to the accompanying drawings, which form a part of this application. The drawings show, by way of illustration, specific embodiments in which the invention may be practiced. It is to be understood that other embodiments may be utilized and structural changes may be made without departing from the scope of the appended claims.

Figure 1:
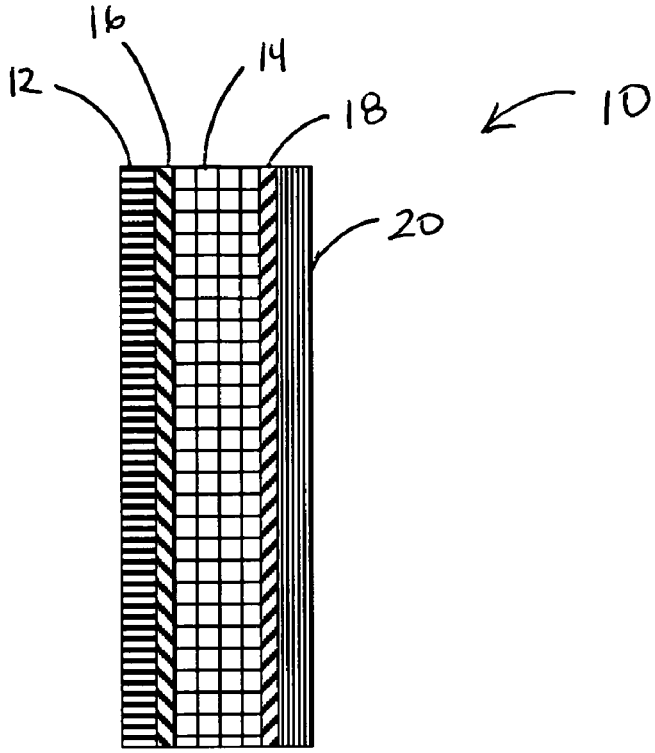
FIG. 1 is a side view of a training aid.

Referring to FIG. 1, there is shown a side view of an illustrative training aid. The illustrative training aid 10 comprises a first sheet 12 that is composed of an opaque and malleable material that is deformed upon impact with a ball. The malleable material in the first sheet 12 is capable of being shaped or deformed. In the illustrative embodiment, the opaque and malleable material is a metallic material. A metallic material is a material that contains metal or has the properties of a metal. Generally, metallic materials are opaque, ductile and malleable. Those skilled in the art shall appreciate that a metallic material includes an alloy. An alloy is composed of two or more metals or of a metal and a nonmetal. By way of example and not of limitation, the illustrative opaque and malleable material is a sheet of aluminum foil that is sized to fit an illustrative hitting instrument. Alternatively, the opaque and malleable material is a sheet of copper foil. By way of example and not of limitation, the illustrative first sheet ranges in depth from $^{3}/_{1000}$ of an inch to $^{5}/_{1000}$ of an inch.

The deformable sheet 14 is attached to the first sheet 12. As compared to the malleable and opaque material in the first sheet 12, the deformable sheet 14 can change its shape by stress. Depending on the amount of stress that is applied, the deformable sheet may also have elastic properties which permits the deformable sheet to possess the quality of being springy and resilient. Typically, the deformable sheet is thicker than the first sheet.

In the illustrative embodiment, an adhesive layer 16 on the front face of the deformable sheet 14 is used to attach the opaque and malleable first sheet 12 to the deformable sheet 14. Another adhesive layer 18 on the back face of the deformable sheet 14 is coupled or interfaces with a non-stick sheet 20 having a non-stick surface. The non-stick sheet 20 is removed prior to affixing the training aid 10 to a hitting instrument (not shown). The adhesive layer 18 on the back face of the deformable sheet 14 is configured to leave little or no adhesive residue on the hitting instrument when the training aid is removed from the hitting instrument.

In one embodiment, the deformable sheet 14 is a piece of balsa wood that has a thickness of 3/32 inches. In another embodiment, the deformable sheet 14 is composed of a 6-lb foam material that has a thickness of 3/32 inches. In yet another embodiment, the deformable sheet 14 is composed of well-known athletic tape. For illustrative purposes only, the non-stick sheet 20 is a sheet of wax paper.

More generally, there are a plurality of means for affixing the deformable sheet 14 of the illustrative training aid 10 to the hitting instrument (not shown). The means for affixing include but are not limited to using an adhesive material as described above, using a slip cover having the training aid disposed thereon wherein the slip cover substantially surrounds the hitting instrument, using one more materials that have small hooks such as a "velcro" material which attaches the training aid to the hitting instrument, using a mechanical device such as a metallic or plastic clip to affix the training aid to the hitting instrument, using magnetic coupling to fixedly couple the training aid to the hitting instrument, or any combination thereof in which the materials provide for the affixing of the training aid to the hitting instrument.

Figure 2:
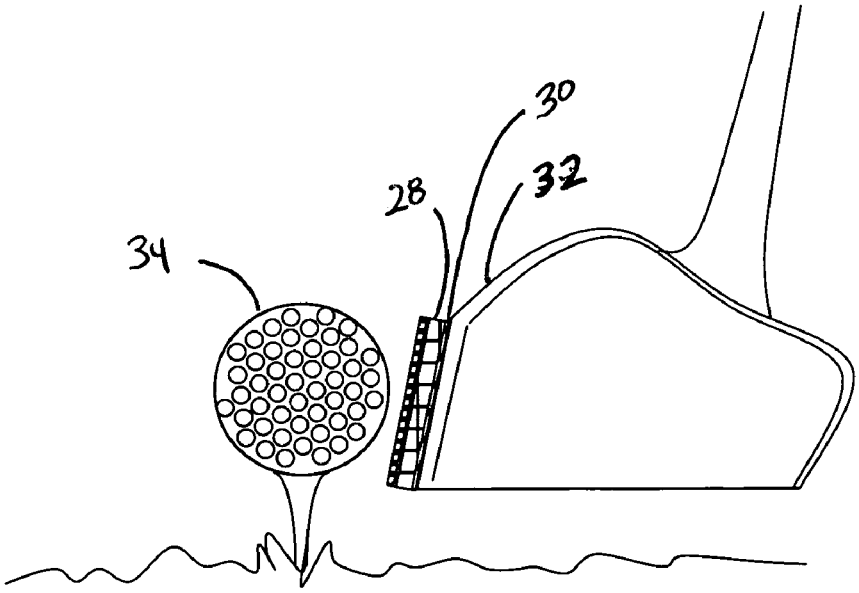
FIG. 2 is a side view of the training aid affixed to a golf club and prior to impact with a golf ball.

For illustrative purposes, the training aid 10 is configured for use in the game of golf. The golf training aid 28 is attached to the face of a golf club, which strikes a golf ball. Referring to FIG. 2, there is shown a side view of the golf training aid 28 affixed to a face 30 of a golf club 32 prior to impact with a golf ball 34. The golf training aid 28 is configured so that it is shaped to fit the face 30 of the golf club 32.

For the illustrative example of golf, the method for using the illustrative golf training aid 28 comprises affixing the training aid 28 to the face 30 the golf club 32. As described previously, the illustrative golf training aid 28 is comprised of a first sheet that is composed of a metallic material, a second deformable sheet, and an adhesive configured to affix the training aid 28 to the illustrative hitting instrument 32. The player then proceeds to strike the illustrative golf ball 34 with the golf club 32. An impression of how the ball 34 was struck is then generated on the golf training aid 28.

After generating the impression on the training aid 28, the player can interpret the impression to determine how to better strike the ball. Typically, the impression comprises a ball pattern and one or more ridges which indicates the direction of travel for the hitting instrument. The player can then proceed to repeat the process of striking the illustrative 34 without having to remove the training aid 28. Once there are too many impressions on the golf training aid 28, the player can dispose of the training aid 28 and replace the club face with another golf training aid 28 that has no impressions. Alternatively, the player can remove the training aid and play or practice without the training aid. The adhesive used to affix the golf training aid 28 leaves little or no residue on the hitting instrument.

The illustrative golf training aid 28 can be used on any golf club whether iron, woods, wedges or putters. Additionally, as described above the training aid 10 and method of using the training aid can be adapted to be used in a variety of sports in which a hitting instrument strikes a ball. By way of example, these sport games include baseball, hockey, tennis, cricket and any other such game.

Figure 3:
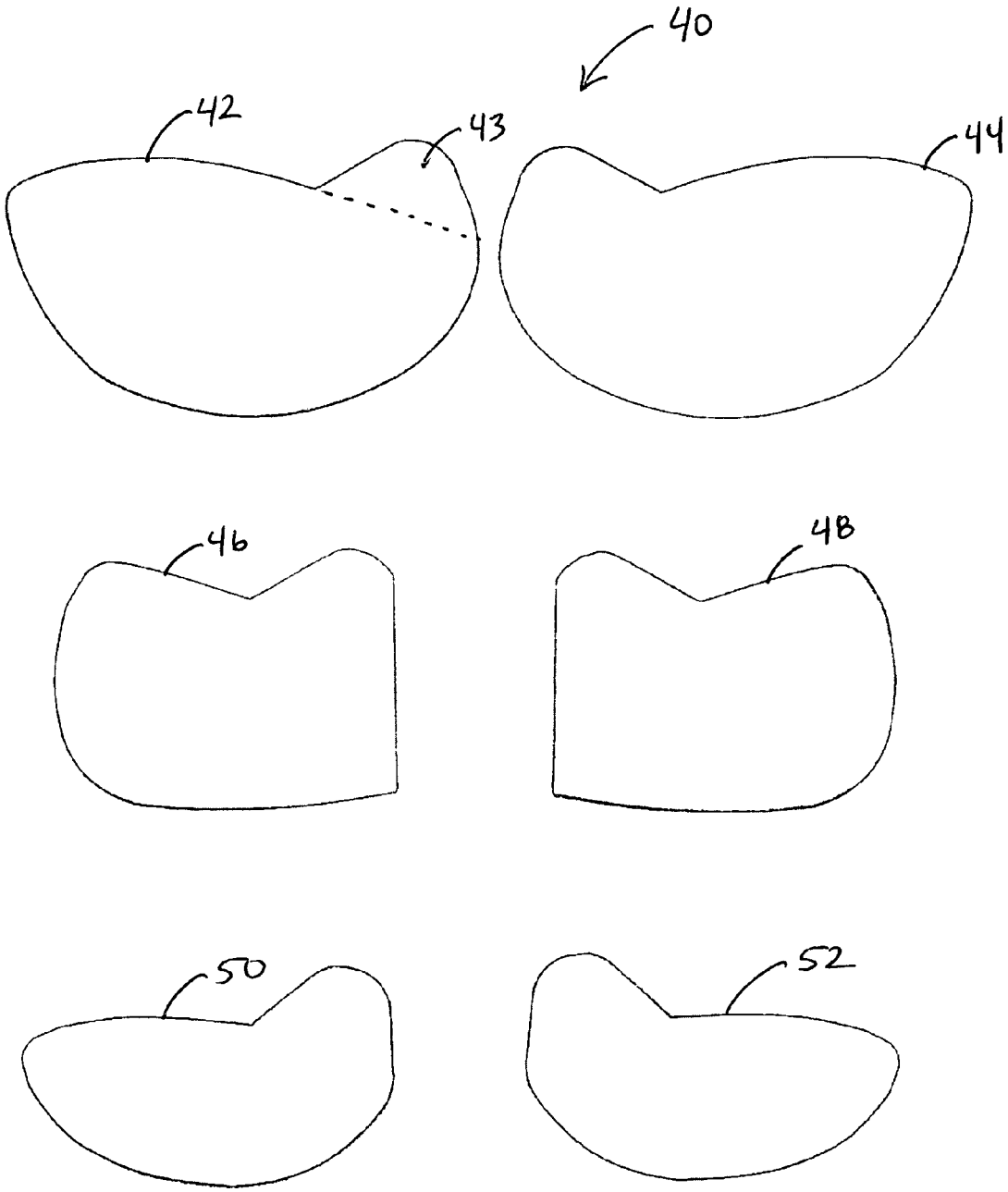
FIG. 3 is a front view of different shaped cut outs of the golf training aid.

Referring to FIG. 3 there is shown a front view of cut outs 40 of the golf training aid 28 that have been shaped for a variety of different club faces. For example, the cut out for a right-hand wood driver is right hand wood #1 cut out 42. The cut out 42 includes a tab 43, which does not conform to the club face. The tab 43 provides the function of permitting the cut out 42 to be simply removed from the hitting instrument by pulling on the tab 43. Additionally, the tab 43 provides a writing surface so that a player can record data. The cut-out may then be stored in a booklet and used to track the player's progress.

For a left-handed player, the cut out 42 is flipped horizontally resulting in cut-out 44, which is cut-out for a left-handed wood driver. The cut out 46 is for right hand irons ranging from iron #1 through #9. The cut out 48 is for a left-handed player's irons ranging from #1 through #9. The cut outs 50 and 52 are for right hand woods #2 through #7 and left hand woods #2 through #7, respectively. As described above, each of the cut outs includes a tab that does not conform to the club face.

Figure 4:
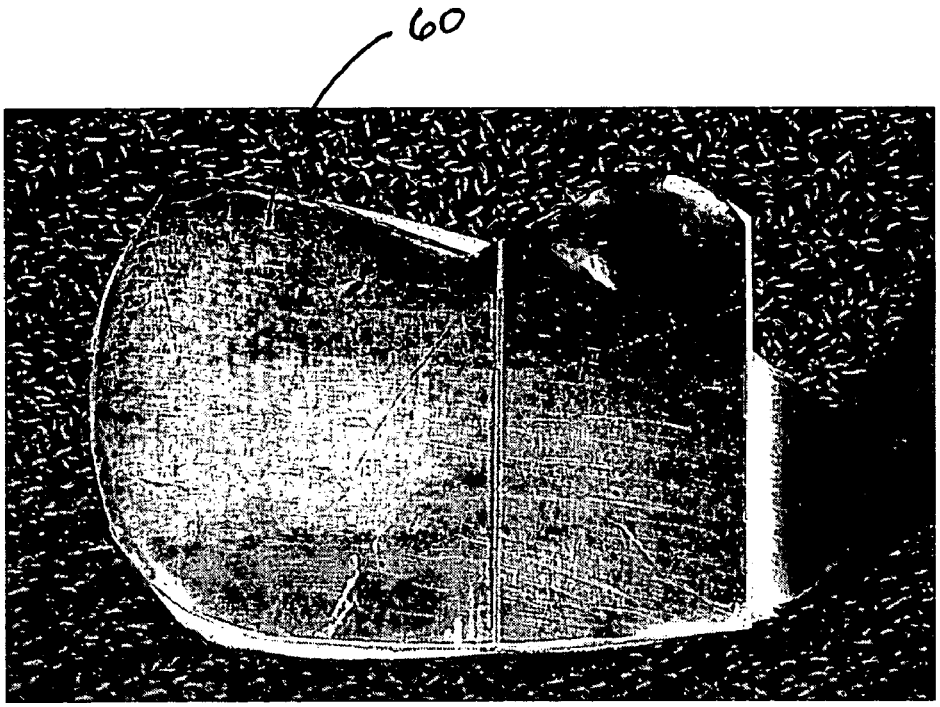
FIG. 4 there is a front view of the training aid affixed to a golf club before impact is made with a golf ball.

Referring to FIG. 4 there is shown a front view of an illustrative golf training aid affixed to the face of a golf club before impact is made with a golf ball. The illustrative training aid 60 is affixed to an "iron" and is shown before the player strikes a golf ball.

Figure 5:
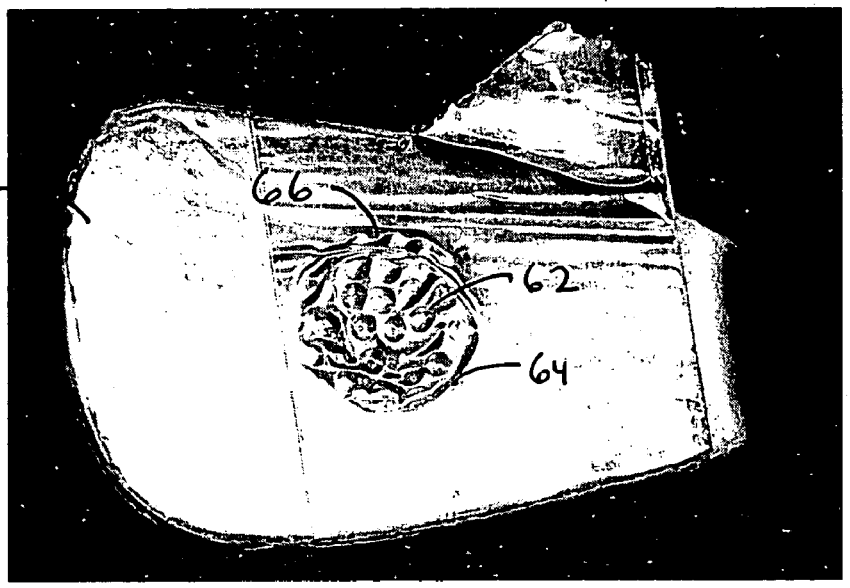
FIG. 5 is a front view after impact is made with a golf ball within the sweet spot of the golf club.

After striking the ball, one or more deformations are generated that provides an impression of how a ball was struck by a hitting instrument. In FIG. 5, there is shown a front view of the illustrative golf training aid 60 after impact is made within the sweet spot of the golf club. The dimple pattern 62 of a golf ball (not shown) is visible on illustrative golf training aid 60. The dimple pattern 62 indicates the location of the "strike zone". The strike zone is the location where the ball was struck by the face of the golf club.

The diameter and depth of the dimple pattern in the strike zone can be used to determine how hard the ball was struck. If the ball is struck harder, the diameter and depth of the dimple pattern is greater than if the ball is struck with a lighter force. To determine the amount of force used to strike the ball, the malleable surface of the training aid can be analyzed by using a depth gauge that determines the depth of the strike zone. Alternatively, a player can simply touch the malleable surface of the training aid to determine the relative depth of the dimple pattern in the strike zone.

In addition to the dimple pattern 62, one or more ridges 64 are visible at the edges of the strike zone. Upon closer inspection, some of the ridges 64 that surround the dimple pattern 62 are more pronounced in one location than in another location. More particularly, the most concentrated ridge pattern appears confined to the top portion 66 of the strike zone. The concentrated ridge pattern 66 is indicated by the compressed visible grooves located at the top edge of dimple pattern 62. The concentrated ridge pattern 66 indicates that the ball was struck as the face of the golf club was travelling down to hit the golf ball. This is the preferred method for hitting a golf ball.

Figure 6:
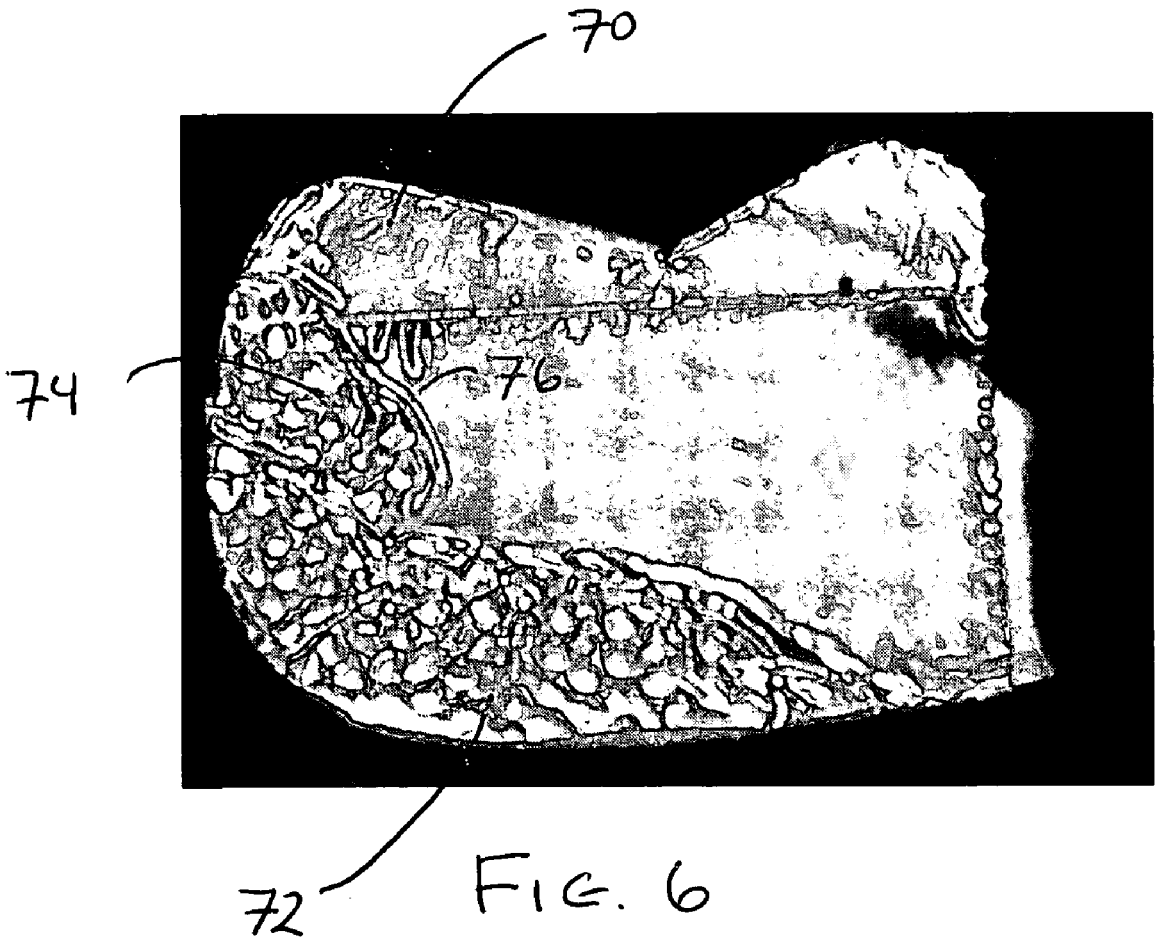
FIG. 6 is a front view of the training aid after a plurality of impacts on the edges of the club face.

Referring to FIG. 6 there is shown a front view of a golf training aid after a plurality of impacts on the edges of the face of a golf club. In the illustrative example of golf training aid 70, a number of golf balls have been struck without hitting the "sweet spot". Most of impressions are shown on the bottom edge 72 of the club face and on the side edge 74 of the club face. The majority of impressions shown on the bottom edge 72 are dimple patterns with weak ridge patterns. Additionally, the impressions shown on the side edge 74 of the club face show more clear dimple patterns with concentrated ridge patterns 76 on the right side of each strike zone. By way of example and not limitation, the combination of the impressions may indicate that the player is "slicing" the ball when the player first addresses the ball. However, when the player corrects for his "slice", the player only proceeds to "top" the ball. The slice may be indicated by the impressions on the side edge 74. The topping of the ball may be indicated by the impression on the bottom edge 72.

It shall be appreciated by those skilled in the art having the benefit of this disclosure that a training aid apparatus and a method for using the training aid apparatus has been described above. Additionally, the impressions generated by the training aid can be used to assist the player in improving their game. Although, the illustrative example focuses on the game of gold, those skilled in the art will appreciate that the training aid can be adapted to a variety of different games in which a player strikes a ball with a hitting instrument.

Thus, although the description above contain many limitations in the specification, these limitations should not be construed as limiting the scope of the invention but as merely providing illustrations of some of the presently preferred embodiments of this invention. Thus, the scope of the invention should be determined by the appended claims and their legal equivalents rather than by the examples given.

What is claimed is:

1. A training aid configured to strike a ball, comprising:

an opaque and malleable material that is configured to receive at least one impression formed upon impact with said ball and a hitting instrument, said impression comprising a ball pattern having a depth, a strike zone and at least one ridge, wherein said at least one impression that is generated after striking the ball provides information about how the ball was struck;

a deformable sheet that is thicker than said opaque and malleable material having a front face that is adhesively attached to said opaque and malleable material, said deformable sheet additionally having a back face with an adhesive material that is configured to be affixed to said hitting instrument;

said adhesive backing configured to permit removing the training aid from the hitting instrument with little or no adhesive residue remaining on the hitting instrument; and a tab section disposed on one edge of the training aid that does not conform to the shape of the hitting instrument and projects in one direction, said tab section configured to facilitate the removal of the training aid from the hitting instrument; wherein said opaque and malleable material is a metallic material comprising one or more metals and wherein said training aid is adapted for use in a sport selected from the group of sports that consists of golf, baseball and hockey.

2. The training aid of claim 1 wherein said opaque and malleable material is a first metallic sheet that is configured to directly contact said ball.

3. The training aid of claim 2 wherein said tab provides a writing surface for recording data.

4. A training aid, comprising:

a first sheet composed of a metallic material that is configured to receive an impression from a ball upon impact with a hitting instrument, said impression comprising a ball pattern having a depth, a strike zone and at least one ridge, wherein said at least one impression that is generated after striking the ball provides information about how the ball was struck;

a second sheet composed of a deformable material that is adhesively attached to said first sheet, said second sheet having a back face;

a first adhesive layer on said back face of said second sheet, said first adhesive layer attached to a non-stick surface, said first adhesive layer configured to permit removing the training aid from the hitting instrument with little or no residue remaining on the hitting instrument; and a tab section disposed on one edge of the training aid that does not conform to the shape of the hitting instrument and projects in one direction, said tab section configured to facilitate the removal of the training aid from the hitting instrument; wherein said training aid is adapted for use in a sport selected from the group of sports that consists of golf, baseball and hockey.

5. The training aid of claim 4 wherein said second sheet is thicker than said first sheet.

6. The training aid of claim 5 wherein said first layer is composed of aluminum.

7. A training aid, comprising:

a sheet further comprising a metallic top layer that is configured to contact a ball and be deformed upon impact with said ball, producing at least one impression comprising a ball pattern having a depth, a strike zone, and at least one ridge, wherein said at least one impression that is generated after striking the ball provides information about how the ball was struck, said sheet having a back face;

an adhesive layer on said back face of said sheet, said adhesive layer having an adhesive that interfaces with a non-stick sheet that is configured to be removed prior to affixing said training aid to a hitting instrument, said adhesive configured to leave little or no adhesive residue on said hitting instrument when said training aid is removed; and a tab section disposed on one edge of the training aid that does not conform to the shape of the hitting instrument and projects in one direction, said tab section configured to facilitate the removal of the training aid from the hitting instrument; wherein said training aid further comprises a deformable sheet that is attached to said metallic top layer wherein said training aid is adapted for use in a sport selected from the group of sports that consists of golf, baseball and hockey.

8. The training aid claim 7 wherein said deformable sheet is thicker than said metallic top layer accommodate said impression depth.

9. The golf training aid of claim 8 wherein said metallic top layer is composed of aluminum.

* * * * *